US009707980B2

(12) United States Patent
Mautino et al.

(10) Patent No.: US 9,707,980 B2
(45) Date of Patent: Jul. 18, 2017

(54) RAILWAY CAR COUPLER AND KNUCKLE SYSTEM AND METHOD

(71) Applicant: McCONWAY & TORLEY, LLC, Dallas, TX (US)

(72) Inventors: P. Scott Mautino, Pittsburgh, PA (US); Joseph L. Gagliardino, Oakdale, PA (US); Joseph Float, Monroeville, PA (US)

(73) Assignee: McCONWAY & TORLEY, LLC, Dallas, TX (US)

( * ) Notice: Subject to any disclaimer, the term of this patent is extended or adjusted under 35 U.S.C. 154(b) by 204 days.

(21) Appl. No.: 14/647,961

(22) PCT Filed: Mar. 13, 2014

(86) PCT No.: PCT/US2014/026375
§ 371 (c)(1),
(2) Date: May 28, 2015

(87) PCT Pub. No.: WO2014/151745
PCT Pub. Date: Sep. 25, 2014

(65) Prior Publication Data

US 2015/0375762 A1 Dec. 31, 2015

Related U.S. Application Data

(60) Provisional application No. 61/793,859, filed on Mar. 15, 2013.

(51) Int. Cl.

| | |
|---|---|
| ***B61G 3/00*** | (2006.01) |
| ***B61G 3/06*** | (2006.01) |
| ***B61G 1/10*** | (2006.01) |

(52) U.S. Cl.
CPC ..... *B61G 3/06* (2013.01); *B61G 1/10* (2013.01)

(58) Field of Classification Search
CPC ... B61G 1/00; B61G 3/04; B61G 3/06; B61G 3/10

(Continued)

(56) References Cited

U.S. PATENT DOCUMENTS 2,548,479 A * 4/1951 Kayler ..... B61G 3/04 213/152
2,772,791 A * 12/1956 Wolfe ..... B61G 3/04 213/150

(Continued)

OTHER PUBLICATIONS

Patent Examination Report No. 1 issued by the Australian Government for Application No. 214236958, Sep. 1, 2015.

*Primary Examiner* — Jason C Smith
(74) *Attorney, Agent, or Firm* — Baker Botts, LLP

(57) ABSTRACT

A railway car coupler system includes a railcar coupler comprising a coupler head portion extending from a shank portion. The coupler head portion is configured to couple to a first coupler knuckle for coupling the railcar coupler to a second railcar coupler of an adjacent railcar. The coupler head portion comprises a coupler pivot pin hole for receiving a pivot pin for coupling the railcar coupler to the first coupler knuckle. The pivot pin hole has a longitudinal axis. The coupler head portion comprises top and bottom coupler pulling lugs each having a respective coupler pulling lug engagement face. At least one of the coupler pulling lug engagement faces of the top and bottom coupler pulling lugs is angled with respect to the longitudinal axis.

14 Claims, 7 Drawing Sheets

(58) Field of Classification Search
USPC ..... 213/75 R, 77, 100 R, 151, 152, 155
See application file for complete search history.

(56) References Cited

U.S. PATENT DOCUMENTS

| | | | | | |
|---|---|---|---|---|---|
| 4,976,363 | A * | 12/1990 | Altherr | B61G 3/06 | 213/155 |
| 4,984,696 | A * | 1/1991 | Altherr | B61G 3/04 | 213/1 R |
| 7,861,433 | B2 * | 1/2011 | Saeler | G01B 3/14 | 33/546 |
| 7,896,179 | B2 * | 3/2011 | Hanaway | B61G 7/00 | 213/155 |
| 2013/0277325 | A1 * | 10/2013 | Hanaway | B61G 3/04 | 213/155 |
| 2014/0336073 | A1 * | 11/2014 | Kollaredy | C12Q 1/6886 | 506/9 |
| 2015/0375762 | A1 * | 12/2015 | Mautino | B61G 1/10 | 213/155 |

* cited by examiner

RAILWAY CAR COUPLER AND KNUCKLE SYSTEM AND METHOD

PRIORITY INFORMATION

The present application is a U.S. National Stage Filing under 35 U.S.C. §371 of International Patent Application Serial No. PCT/US2014/026375 filed Mar. 13, 2014 and entitled "RAILWAY CAR COUPLER AND KNUCKLE SYSTEM AND METHOD" and claims benefit of U.S. Provisional Application Ser. No. 61/793,859, filed Mar. 15, 2013, and incorporated by reference herein.

TECHNICAL FIELD

The present disclosure is related to railway car couplers, and more particularly to a railway car coupler and knuckle system and method.

BACKGROUND

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

In many cases when a railcar knuckle fails, a replacement knuckle must be carried from the locomotive at least some of the length of the train, which may be up to 25, 50 or even 100 railroad cars in length. The repair of a failed coupler can be labor intensive, can sometimes take place in very inclement weather and can cause train delays.

SUMMARY

In accordance with a particular embodiment, a railway car coupler system includes a railcar coupler comprising a coupler head portion extending from a shank portion. The coupler head portion is configured to couple to a first coupler knuckle for coupling the railcar coupler to a second railcar coupler of an adjacent railcar. The coupler head portion comprises a coupler pivot pin hole for receiving a pivot pin for coupling the railcar coupler to the first coupler knuckle. The pivot pin hole has a longitudinal axis. The coupler head portion comprises top and bottom coupler pulling lugs each having a respective coupler pulling lug engagement face. At least one of the coupler pulling lug engagement faces of the top and bottom coupler pulling lugs is angled with respect to the longitudinal axis.

The at least one coupler pulling lug engagement face angled with respect to the longitudinal axis may be angled approximately 30 degrees from the longitudinal axis. The first coupler knuckle may comprise top and bottom knuckle pulling lugs for engaging with the top and bottom coupler pulling lugs, respectively. The top and bottom knuckle pulling lugs may each have a respective knuckle pulling lug engagement face. At least one of the knuckle pulling lug engagement faces of the top and bottom knuckle pulling lugs may be angled with respect to the longitudinal axis.

In accordance with another embodiment, a method includes casting a railcar coupler comprising a coupler head portion extending from a shank portion. The coupler head portion is configured to couple to a first coupler knuckle for coupling the railcar coupler to a second railcar coupler of an adjacent railcar. The coupler head portion comprises a coupler pivot pin hole for receiving a pivot pin for coupling the railcar coupler to the first coupler knuckle. The pivot pin hole has a longitudinal axis. The coupler head portion comprises top and bottom coupler pulling lugs each having a respective coupler pulling lug engagement face. At least one of the coupler pulling lug engagement faces of the top and bottom coupler pulling lugs is angled with respect to the longitudinal axis.

Technical advantages of particular embodiments include angled pulling lugs which facilitate distribution of load on both sets of pulling lugs even if only one makes contact during engagement. This is intended to prevent loading of only one set of pulling lugs in some circumstances. In addition, an increased distance between a pivot pin hole and pivot pin protector better ensures that the pivot pin is not loaded before the pulling lugs. Moreover, a mating geometry between a lock and a knuckle better ensures that the lock will move in place with the knuckle during coupler engagement.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of embodiments of the invention will be apparent from the detailed description taken in conjunction with the accompanying drawings in which.

DETAILED DESCRIPTION

Example embodiments and their advantages are best understood by referring to FIGS. 1 through 9 of the drawings.

Figure 1:
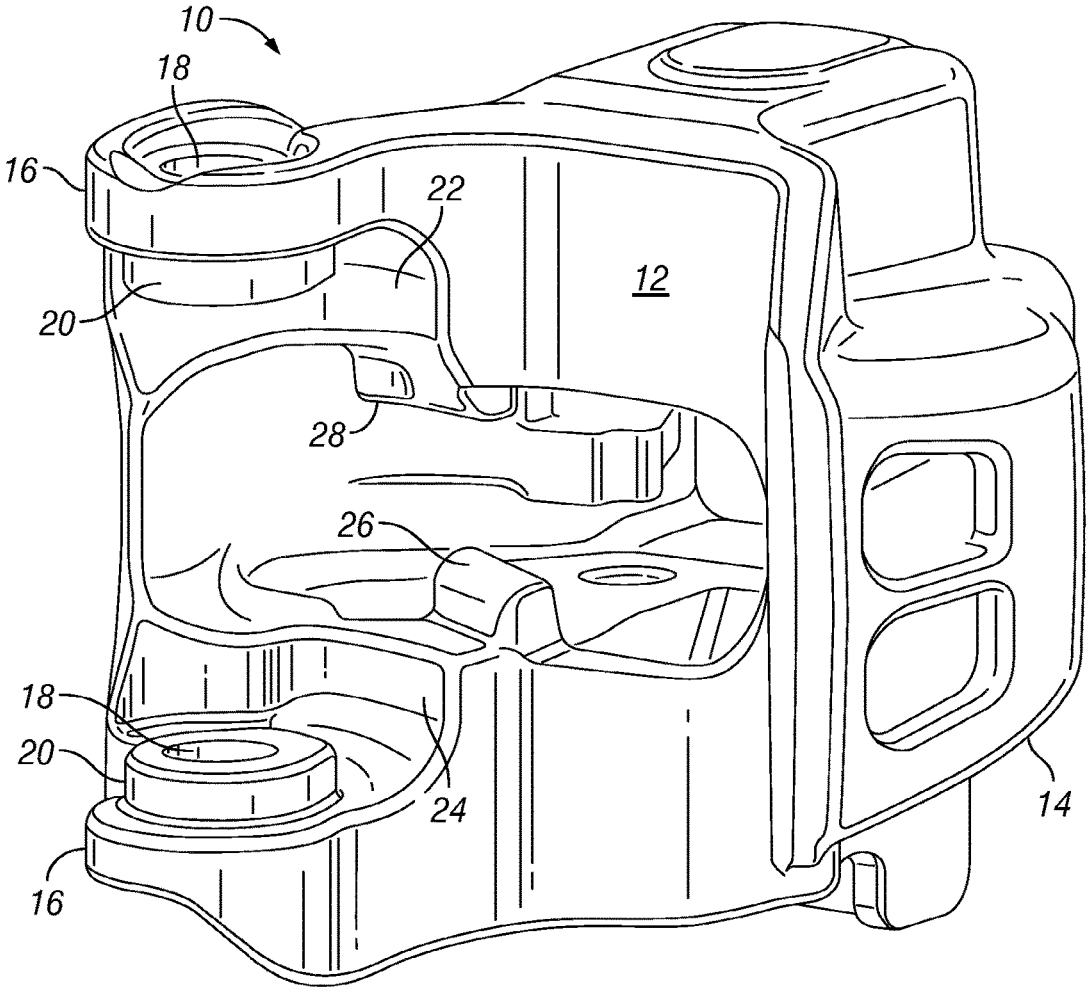
FIG. 1 illustrates a railway car coupler head.

FIG. 1 illustrates a railway car coupler head 10. Railway car coupler head 10 may be part of a type E coupler, a type F coupler, a type EF coupler, or another type of coupler. A type E coupler head is illustrated. Coupler head 10 includes guard arm 14. Opposite guard arm 14 is the knuckle side of coupler head 10. Between the knuckle side and guard arm 14 is front face 12.

Coupler head 10 may be configured to receive a knuckle. The knuckle may be received and retained in a pivotal manner with a pivot pin that extends through pivot pin holes 18 of pivot lugs 16. The pin may be protected by pin protectors 20 when it extends through pivot pin holes 18 and a corresponding pin hole in the knuckle. Located behind pivot lugs 16 are top buffing shoulder 22 and bottom buffing shoulder 24. Together, top and bottom buffing shoulders 22 and 24 form a pocket for receiving the knuckle. Buffing shoulders 22 and 24 may receive the transferred load from an interfacing surface of a knuckle when the railway car experiences buff (pushing) motions.

Extending from a lower portion of coupler head 10 adjacent bottom buffing shoulder 24 is bottom pulling lug 26. Extending from a top surface of coupler head 10 adjacent top buffing shoulder 22 is top pulling lug 28. At least a portion of top pulling lug 28 may be generally aligned with a portion of bottom pulling lug 26.

When a knuckle is assembled with coupler head 10, pulling lugs 26 and 28 may engage corresponding pulling lug surfaces of the knuckle. This engagement may allow pulling lugs 26 and 28 to receive a transfer draft load from a corresponding knuckle of a mating coupler on an adjacent railcar.

The knuckle (and its identical counterpart on an adjacent coupler) may operate by contacting the guard arm of an adjacent coupler. In a joining operation, the knuckle of coupler head 10 and the opposing knuckle may each pivot inward to a degree sufficient to lock the two knuckles in place behind each other so that coupler head 10 is properly joined with the adjacent coupler. A lock member slidably disposed within each coupler head 12 may be activated by the engagement to slide downward within the coupler head 10 and lock the knuckle in place to thereby join the two railway couplers together.

Figure 2:
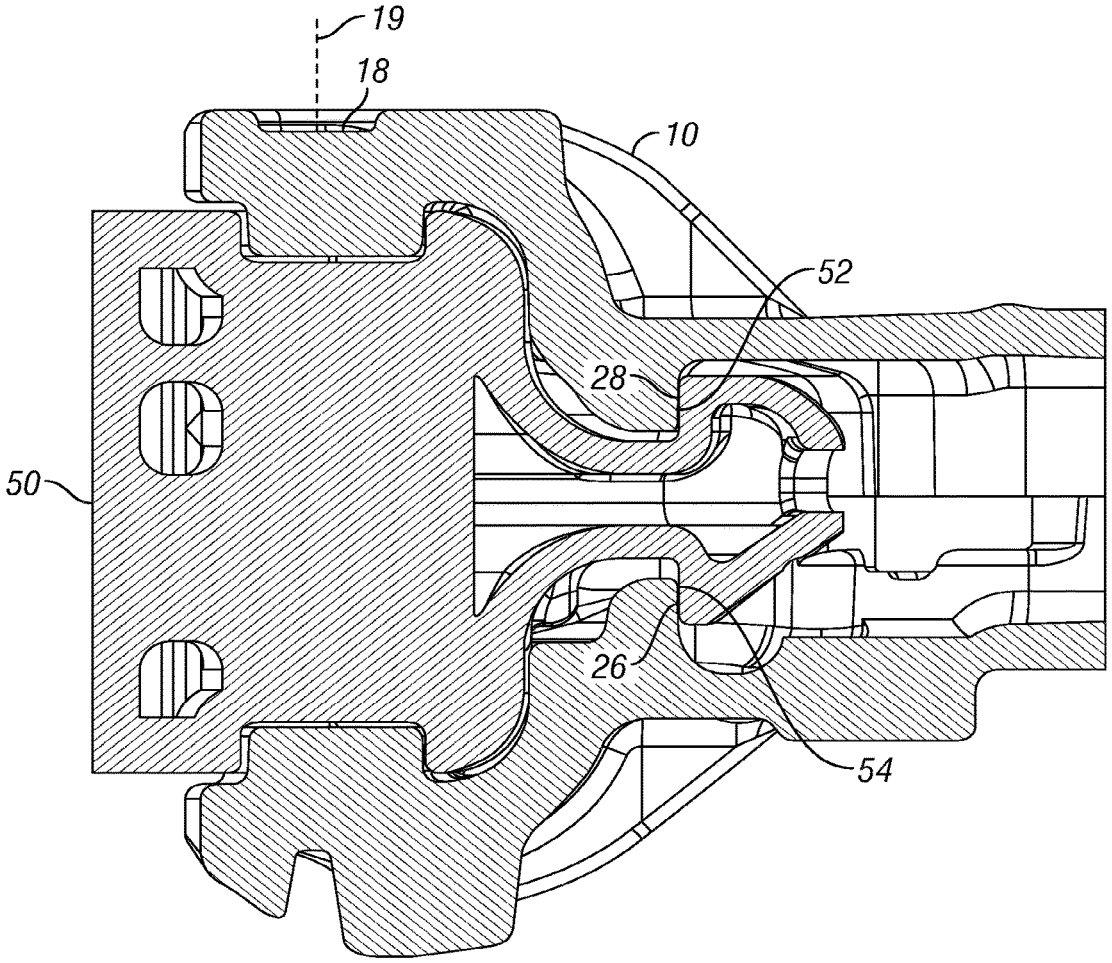
FIG. 2 illustrates coupler of FIG. 1 engaged with a knuckle.

FIG. 2 illustrates coupler 10 of FIG. 1 engaged with a knuckle 50. Knuckle 50 includes top knuckle pulling lug 52 and bottom knuckle pulling lug 54. As evident from the figure, these knuckle pulling lugs include engagement faces that engage with engagement faces of top and bottom coupler pulling lugs 28 and 26. Also shown is a longitudinal axis 19 of pivot pin hole 18 of coupler 10. In conventional couplers and knuckles as shown, each of these engagement faces is substantially vertical, or substantially parallel to longitudinal axis 19 of pivot pin hole 18. One problem with the vertical orientation of the pulling lugs is that if misalignment between the coupler and knuckle occurs or if one or more of the pulling lugs wears sufficiently then when the coupler is coupled to another coupler of an adjacent car only one set of pulling lugs may make contact and engage (e.g., top coupler pulling lug 28 with top knuckle pulling lug 52 or bottom coupler pulling lug 26 with bottom knuckle pulling lug 54). If this occurs, then the load will transfer to only one set of the pulling lugs.

Figure 3:
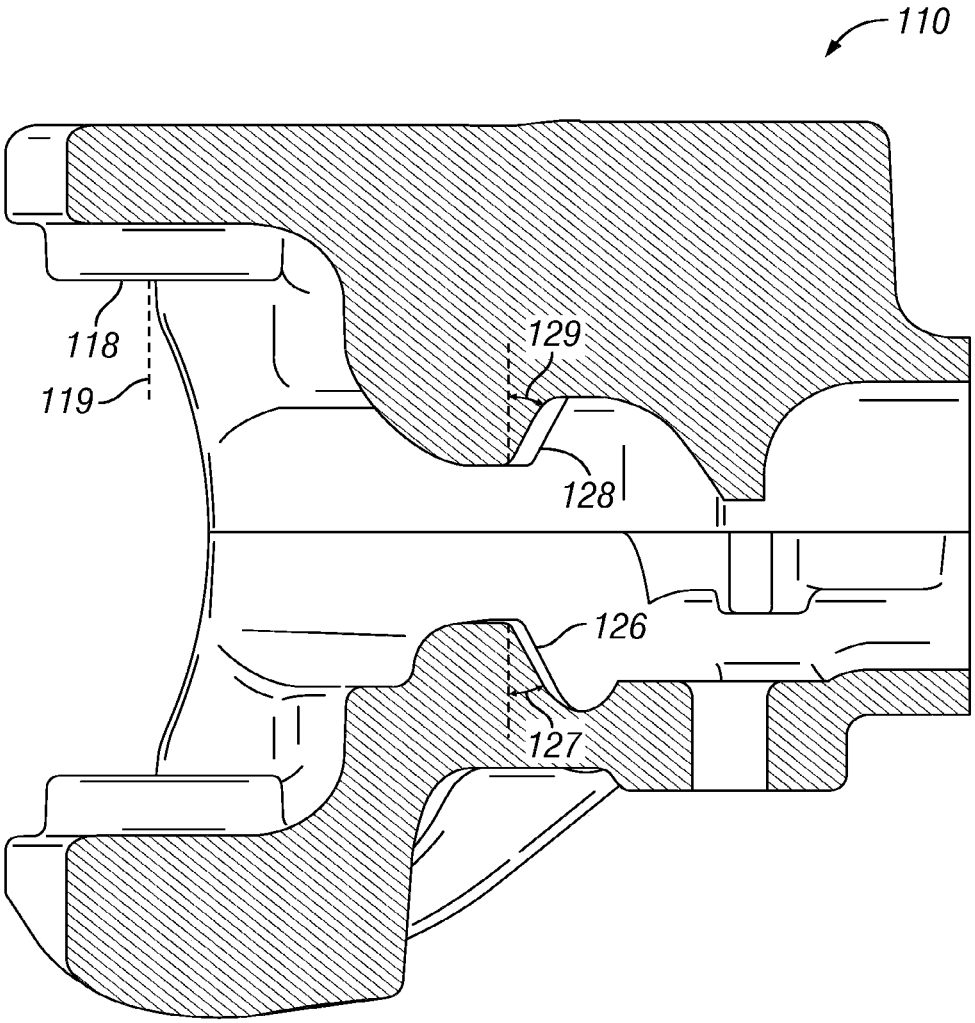
FIG. 3 illustrates a coupler, in accordance with particular embodiments.

FIG. 3 illustrates a coupler 110, in accordance with particular embodiments. Coupler 110 includes top coupler pulling lug 128 and bottom coupler pulling lug 126, both with engagement faces which are angled from the vertical. For example, both are angled with respect to longitudinal axis 119 of pivot pin hole 118. Reference numeral 129 shows the angle of the engagement face of top coupler pulling lug 128 with respect to the vertical, and reference numeral 127 shows the angle of the engagement face of bottom coupler pulling lug 126 with respect to the vertical. Angles 129 and 127 may be any suitable angle to one of ordinary skill in the art. In some embodiments, angles 129 and 127 may be approximately 30 degrees. In some embodiments, angle 129 may be a different angle than angle 127. Particular embodiments may include a coupler with only one of the engagement faces of the top or bottom coupler pulling lugs at an angle with respect to the vertical.

Figure 4:
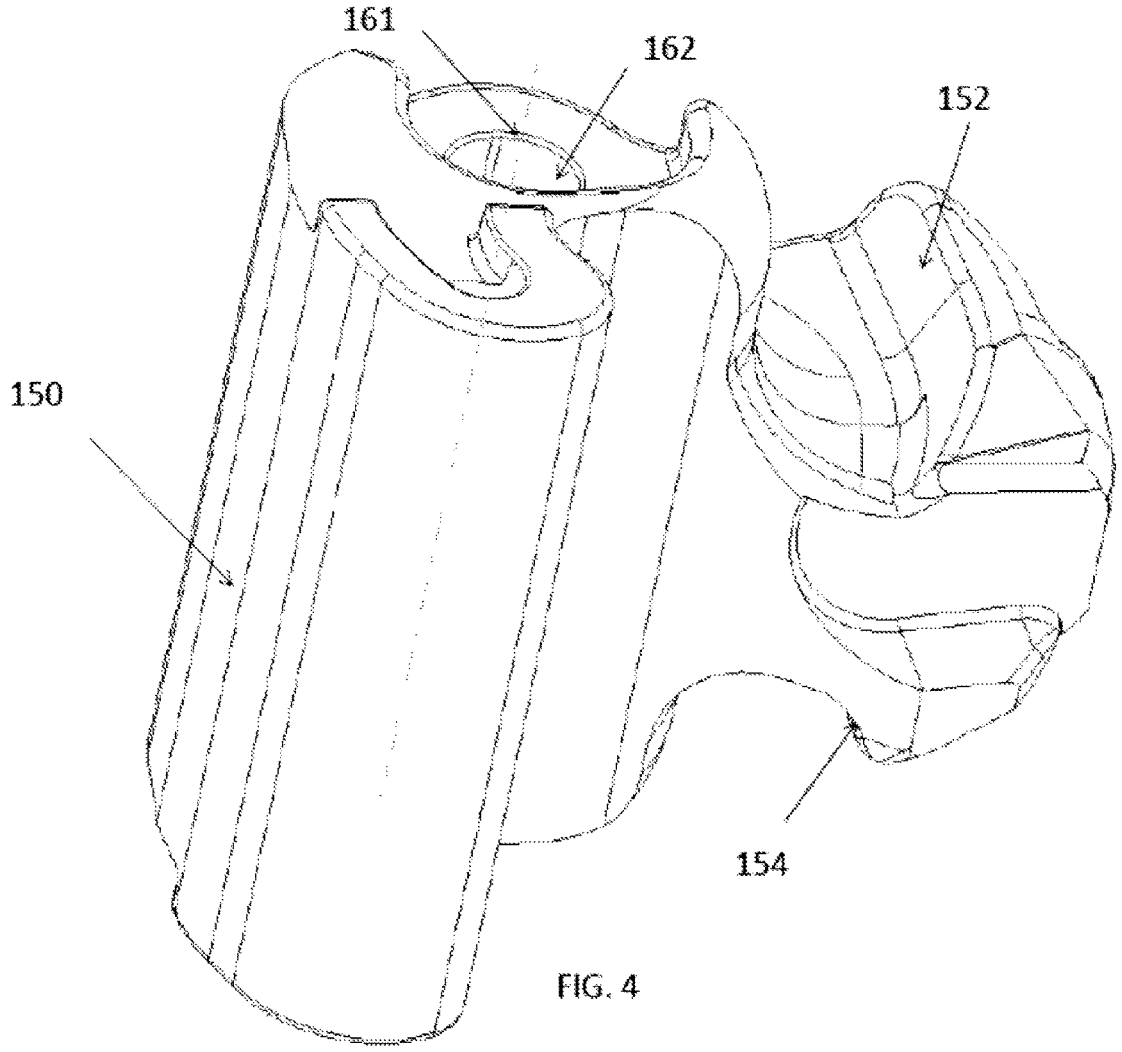
FIG. 4 illustrates a knuckle, in accordance with a particular embodiment.

FIG. 4 illustrates a knuckle 150, in accordance with a particular embodiment. Knuckle 150 includes top knuckle pulling lug 152 and bottom knuckle pulling lug 154. Engagement faces of both top and bottom knuckle pulling lugs 152 and 154 are, like top and bottom coupler pulling lugs 126 and 128 of coupler 110 of FIG. 3, angled with respect to the vertical. For example, both are angled with respect to longitudinal axis 161 of pivot pin hole 162, which may be referred to as a slotted pivot pin hole. The angles with respect to vertical of top and bottom knuckle pulling lugs 152 and 154 may be any suitable angle to one of ordinary skill in the art. In some embodiments, such angles may be approximately 30 degrees. In some embodiments, such angle of top knuckle pulling lug 152 may be a different from such angle of bottom knuckle pulling lug 154. Particular embodiments may include a knuckle with only one of the engagement faces of the top or bottom knuckle pulling lugs at an angle with respect to the vertical.

Figure 5:
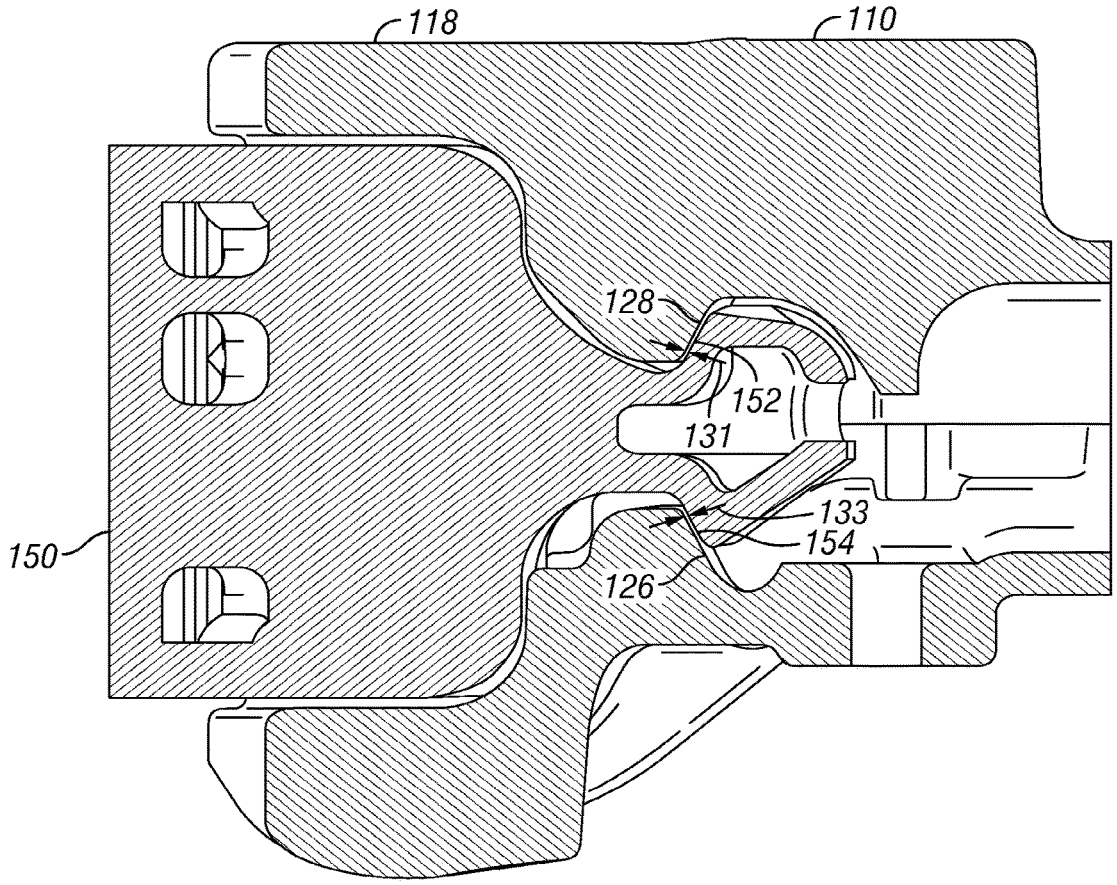
FIG. 5 illustrates the coupler of FIG. 3 engaged with the knuckle of FIG. 4, in accordance with a particular embodiment.

FIG. 5 illustrates coupler 110 of FIG. 3 engaged with knuckle 150 of FIG. 4, in accordance with a particular embodiment. Engagement faces of coupler pulling lugs 128 and 126 and of knuckle pulling lugs 152 and 154 are all angled with respect to the vertical. For example, each is angled with respect to a longitudinal axis of slotted pivot pin hole 118. Having angled pulling lugs facilitates more even distribution of load. For example, if during railcar coupling only one set of pulling lugs makes contact (e.g., top coupler pulling lug 128 with top knuckle pulling lug 152 or bottom coupler pulling lug 126 with bottom knuckle pulling lug 154), then one pulling lug will ride up such that load is distributed on the other set of pulling lugs that did not originally make contact with each other. Thus, if the respective bottom pulling lugs are loaded first, their angled configuration will ensure that both sets of pulling lugs will load.

The engagement faces of top coupler pulling lug 128 and top knuckle pulling lug 152 may include gap distances 131 and 133 between them at initial assembly. In particular embodiments, the coupler and knuckle and their respective pulling lugs may be configured such that gap distances 131 and 133 are approximately 1/16" or less. Such a small distance reduces the chance for shock loading as a result of the small distance of travel of the pulling lugs. Gap distances 131 and 133 may be different in particular embodiments. In particular embodiments, gap distance 131 may be approximately 0.0612", and gap distance 133 may be approximately 0.0294".

Couplers and knuckles of particular embodiments may be manufactured through a casting process with steel or other alloy. Typically one or more cores are used in the manufacturing process in order to form various cavities in the coupler and knuckle. The cores are typically made of resin or otherwise hardened sand. Specifically, the coupler and/or knuckle may each be produced in a mold cavity within a casting box between cope and drag sections. Sand, such as green sand, is used to define the interior boundary walls of the mold cavity. The mold cavity may be formed using a pattern and may include a gating system for allowing molten alloy to enter the mold cavity. The mold cavities define the exterior surfaces of the coupler and knuckle. The cores used to form cavities are placed at appropriate locations within the mold cavity. Once the coupler and/or knuckle is cast, the sand or resin cores may be removed leaving the cavities. The coupler and knuckle may each undergo a metal finishing process that includes finishing the surfaces of the coupler and knuckle.

Figure 6:
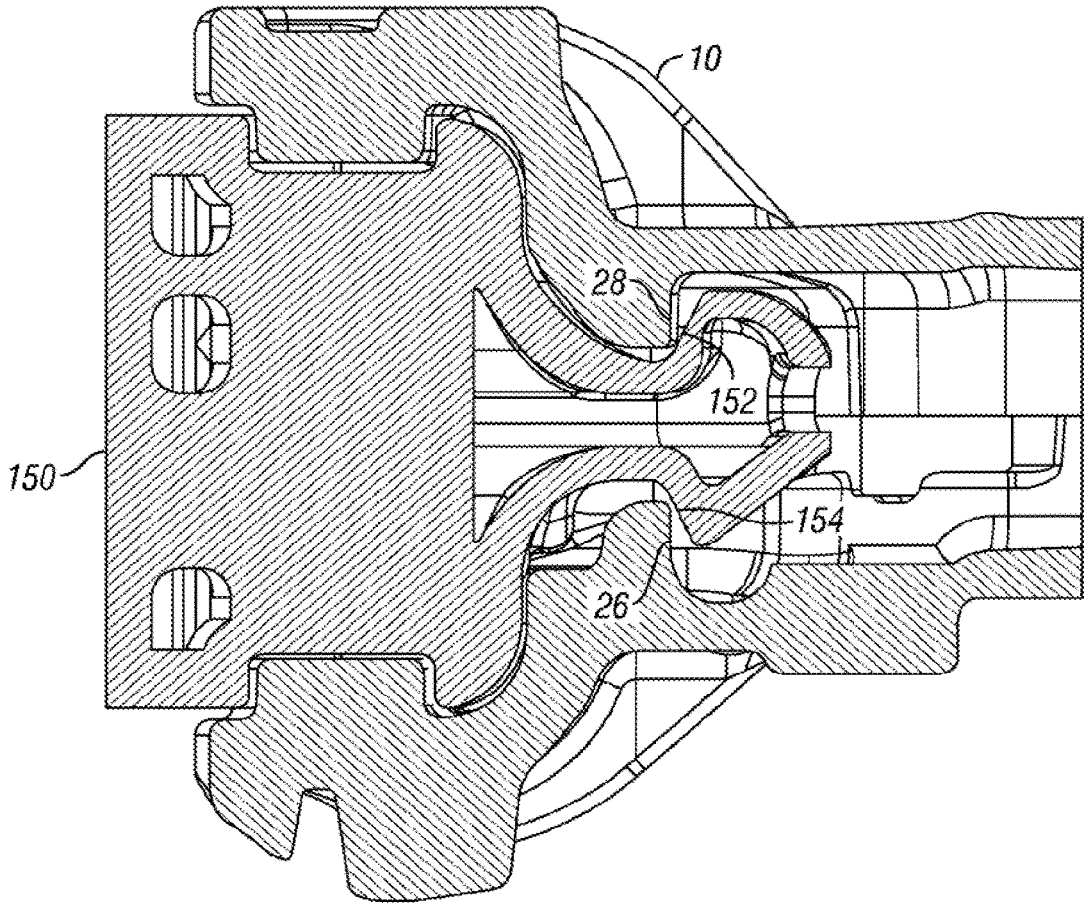
FIG. 6 illustrates a coupler engaged with the knuckle of FIG. 4, in accordance with particular embodiments.

FIG. 6 illustrates coupler 10 engaged with knuckle 150, in accordance with particular embodiments. Coupler 10 includes top knuckle pulling lug 28 and bottom knuckle pulling lug 26, each having engagement faces substantially parallel to vertical. Knuckle 150 includes top coupler pulling lug 152 and bottom coupler pulling lug 154, each having engagement faces angled with respect to vertical. In particular embodiments, a knuckle with one or more angled pulling lugs can be used with a coupler having one or more substantially vertical pulling lugs.

Figure 7:
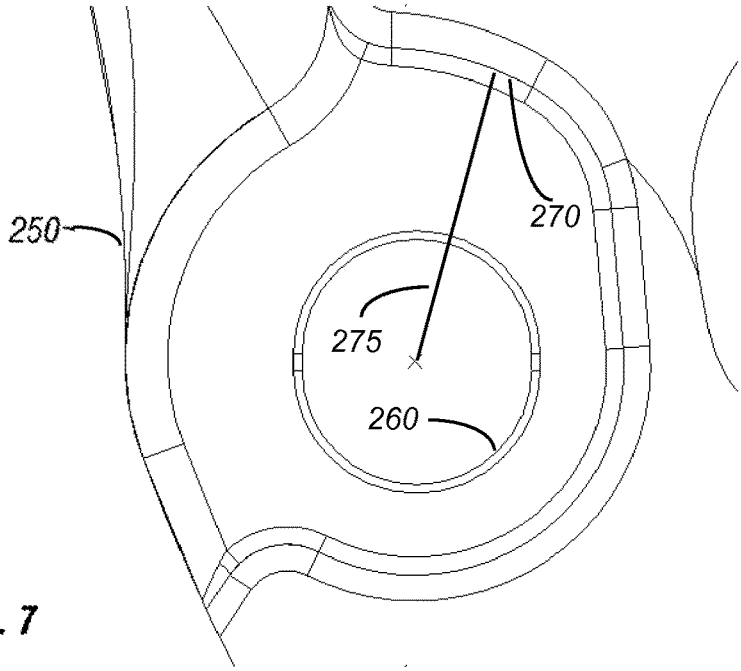
FIG. 7 illustrates a portion of a coupler, in accordance with particular embodiments.

FIG. 7 illustrates a portion of a coupler 250, in accordance with particular embodiments. Coupler 250 includes a hub portion with pivot pin protector wall 270 and slotted pivot pin hole 260. In conventional couplers, a pivot pin protector wall may be closer to the pivot pin hole than what is shown in certain locations. However, in particular embodiments, the pivot pin protector wall may be elongated as illustrated with respect to pivot pin protector wall 270. The elongated shape of pivot pin protector wall 270 increases the distance between slotted pivot pin hole 260 and the pivot pin protector wall to ensure that, as a result of the angled pulling lugs of particular embodiments, the pivot pin protector wall is not loaded first and instead the pulling lugs are loaded first during coupler engagement. In particular embodiments, distance 275 between a center of slotted pivot pin hole 260 and the general portion of pivot pin protector wall 270 shown may be approximately 2.17 inches.

In particular embodiments, slotted pivot pin hole 260 may be elongated as illustrated. Slotted pivot pin hole 260 may provide advantages when using a conventional coupler and a knuckle with angled pulling lugs of particular embodiments. For example, slotted pivot pin hole 260 may minimize additional load that might be placed on a pivot pin when angled pulling lugs of particular embodiments are used with a conventional coupler.

Figure 8:
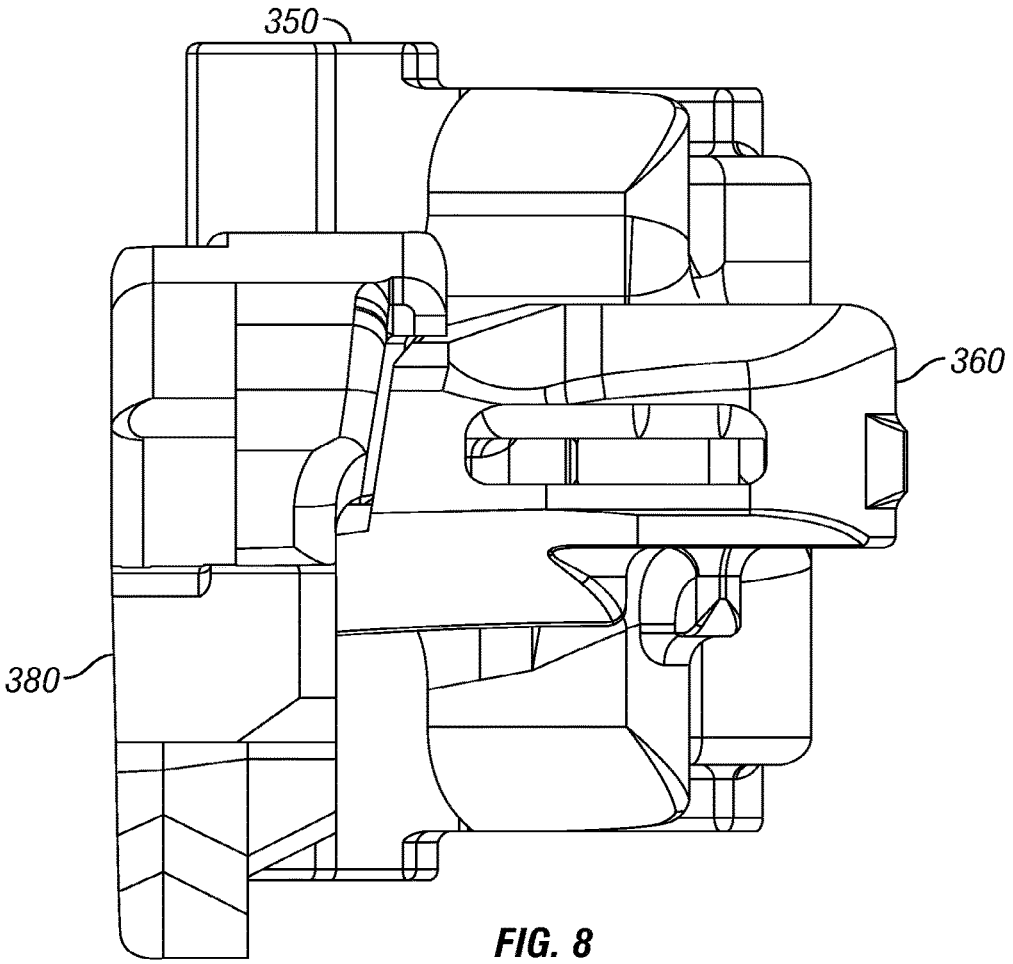
FIGS. 8 and 9 illustrate a coupler and a knuckle engaged with a lock, in accordance with particular embodiments.
Figure 9:
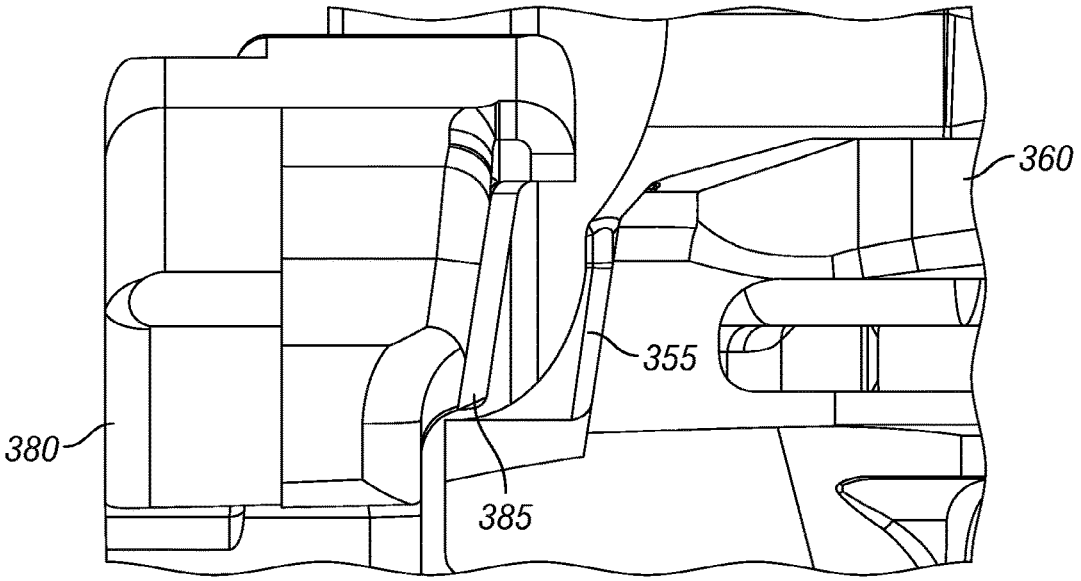

FIGS. 8 and 9 illustrate a coupler 350 and a knuckle 360 engaged with a lock 380, in accordance with particular embodiments. As illustrated, portions of lock 380 and knuckle 360 that engage each other, lock portion 385 and knuckle portion 355, are beveled. In particular embodiments, such beveling may be approximately 8 degrees. Beveling these portions helps them to self-center during engagement. In addition, a boss or protrusion is added to the lock portion or the knuckle portion, and corresponding geometry is provided on the other portion. The angled pulling lugs of particular embodiments cause more longitudinal movement during engagement, which is desired. However, one would not want the knuckle to move relative to the lock as a result of the greater longitudinal movement. Friction may cause the lock to stay where it is relative to the knuckle. With the illustrated mating geometry of lock 380 and knuckle 360, lock 380 will move in place with knuckle 360 as desired.

As described, technical advantages of particular embodiments include angled pulling lugs which facilitate distribution of load on both sets of pulling lugs even if only one makes contact during engagement. This prevents loading of only one set of pulling lugs in some circumstances. In addition, an increased distance between a slotted pivot pin hole and pivot pin protector better ensures that the pivot pin is not loaded before the pulling lugs. In particular embodiments, a mating geometry between a lock and a knuckle better ensures that the lock will move in place with the knuckle during coupler engagement.

Although the present invention and its advantages have been described in detail, it should be understood that various changes, substitutions, and alterations can be made therein without departing from the spirit and scope of the invention as defined by the appended claims.

What is claimed is:

1. A railway car coupler system, comprising:

a railcar coupler comprising:

a coupler head portion extending from a shank portion, the coupler head portion configured to couple to a first coupler knuckle for coupling the railcar coupler to a second railcar coupler of an adjacent railcar;

the coupler head portion comprising a coupler pivot pin hole for receiving a pivot pin for coupling the railcar coupler to the first coupler knuckle, the pivot pin hole having a longitudinal axis; and the coupler head portion comprising top and bottom coupler pulling lugs each having a respective coupler pulling lug engagement face, wherein at least one of the coupler pulling lug engagement faces of the top and bottom coupler pulling lugs is angled with respect to the longitudinal axis.

2. The railway car coupler system of claim 1, wherein:

the first coupler knuckle comprises top and bottom knuckle pulling lugs for engaging with the top and bottom coupler pulling lugs, respectively;

the top and bottom knuckle pulling lugs each has a respective knuckle pulling lug engagement face; and at least one of the knuckle pulling lug engagement faces of the top and bottom knuckle pulling lugs is angled with respect to the longitudinal axis.

3. The railway car coupler system of claim 2, wherein a width of a gap between the coupler pulling lugs and the knuckle pulling lugs is approximately 1/16" or less at initial coupling of the railcar coupler and the first coupler knuckle.

4. The railway car coupler system of claim 2, further comprising a lock, wherein an engagement face of the knuckle that engages an engagement fact of the lock is angled with respect to a vertical axis.

5. The railway car coupler system of claim 4, wherein the engagement face of the knuckle is angled at approximately 8 degrees from the vertical axis.

6. A railway car coupler system, comprising:

a railcar coupler knuckle comprising a tail section, a hub section, and a front face section, the railcar coupler knuckle configured to couple to a first railcar coupler for coupling the first railcar coupler to a second railcar coupler of an adjacent railcar;

the hub section comprising a pivot pin hole for receiving a pivot pin for coupling the railcar coupler knuckle to a first railcar coupler, the pivot pin hole having a longitudinal axis;

the railcar coupler knuckle comprising top and bottom knuckle pulling lugs each having a respective knuckle pulling lug engagement face; and wherein at least one of the knuckle pulling lug engagement faces of the top and bottom knuckle pulling lugs is angled with respect to the longitudinal axis.

7. The railway car coupler system of claim 6, wherein:

the first railcar coupler comprises a coupler head portion extending from a shank portion;

the coupler head portion comprises top and bottom coupler pulling lugs for engaging with the top and bottom knuckle pulling lugs, respectively;

the top and bottom coupler pulling lugs each has a respective coupler pulling lug engagement face; and at least one of the coupler pulling lug engagement faces of the top and bottom coupler pulling lugs is angled with respect to the longitudinal axis.

8. The railway car coupler system of claim 7, wherein a width of a gap between the coupler pulling lugs and the knuckle pulling lugs is approximately 1/16" or less at initial coupling of the railcar coupler and the first coupler knuckle.

9. The railway car coupler system of claim 6, wherein:

the first railcar coupler comprises a coupler head portion extending from a shank portion;

the coupler head portion comprises top and bottom coupler pulling lugs for engaging with the top and bottom knuckle pulling lugs, respectively;

the top and bottom coupler pulling lugs each has a respective coupler pulling lug engagement face; and the coupler pulling lug engagement faces of the top and bottom coupler pulling lugs are substantially parallel to the longitudinal axis.

10. The railway car coupler system of claim 6, further comprising a lock, wherein an engagement face of the knuckle that engages an engagement fact of the lock is angled with respect to a vertical axis.

11. The railway car coupler system of claim 10, wherein the engagement face of the knuckle is angled at approximately 8 degrees from the vertical axis.

12. A method, comprising:

casting a railcar coupler comprising:

a coupler head portion extending from a shank portion, the coupler head portion configured to couple to a first coupler knuckle for coupling the railcar coupler to a second railcar coupler of an adjacent railcar;

the coupler head portion comprising a coupler pivot pin hole for receiving a pivot pin for coupling the railcar coupler to the first coupler knuckle, the pivot pin hole having a longitudinal axis; and the coupler head portion comprising top and bottom coupler pulling lugs each having a respective coupler pulling lug engagement face, wherein at least one of the coupler pulling lug engagement faces of the top and bottom coupler pulling lugs is angled with respect to the longitudinal axis.

13. The method of claim 12, wherein:

the first coupler knuckle comprises top and bottom knuckle pulling lugs for engaging with the top and bottom coupler pulling lugs, respectively;

the top and bottom knuckle pulling lugs each has a respective knuckle pulling lug engagement face; and at least one of the knuckle pulling lug engagement faces of the top and bottom knuckle pulling lugs is angled with respect to the longitudinal axis.

14. The method of claim 13, wherein a width of a gap between the coupler pulling lugs and the knuckle pulling lugs is approximately 1/16" or less at initial coupling of the railcar coupler and the first coupler knuckle.

* * * * *